US009748685B2

(12) United States Patent
Oba et al.

(10) Patent No.: US 9,748,685 B2
(45) Date of Patent: Aug. 29, 2017

(54) MULTI-CONTACT TERMINAL

(71) Applicant: Sumitomo Wiring Systems, Ltd., Yokkaichi, Mie (JP)

(72) Inventors: Fumiya Oba, Mie (JP); Masafumi Uno, Mie (JP); Masayuki Hiramoto, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/037,335

(22) PCT Filed: Nov. 7, 2014

(86) PCT No.: PCT/JP2014/079574
§ 371 (c)(1),
(2) Date: May 18, 2016

(87) PCT Pub. No.: WO2015/076122
PCT Pub. Date: May 28, 2015

(65) Prior Publication Data

US 2016/0285187 A1 Sep. 29, 2016

(30) Foreign Application Priority Data

Nov. 19, 2013 (JP) ..... 2013-239107

(51) Int. Cl.

| | |
|---|---|
| ***H01R 13/11*** | (2006.01) |
| ***H01R 13/187*** | (2006.01) |
| ***H01R 13/115*** | (2006.01) |
| ***H01R 4/02*** | (2006.01) |
| ***H01R 24/20*** | (2011.01) |
| ***H01R 43/16*** | (2006.01) |
| *H01R 4/18* | (2006.01) |

(52) U.S. Cl.
CPC ..... *H01R 13/187* (2013.01); *H01R 4/023* (2013.01); *H01R 4/183* (2013.01); *H01R 13/111* (2013.01);
(Continued)

(58) Field of Classification Search
CPC ... H01R 13/111; H01R 13/113; H01R 13/187; H01R 43/16
(Continued)

(56) References Cited

U.S. PATENT DOCUMENTS 3,786,401 A * 1/1974 Jones ..... H01R 13/114 439/851
4,891,021 A 1/1990 Hayes et al.
(Continued)

FOREIGN PATENT DOCUMENTS

DE 10 2004 052 378 5/2006
JP 2-500014 3/1990
(Continued)

OTHER PUBLICATIONS

International Search Report.

*Primary Examiner* — Hien Vu
(74) *Attorney, Agent, or Firm* — Gerald E. Hespos; Michael J. Porco; Matthew T. Hespos

(57) ABSTRACT

A multi-contact terminal is provided integrally with an angular tube having a polygonal tube shape and a plurality of resilient contact pieces extending from side walls of the angular tube and to be resiliently brought into contact with an outer peripheral surface of a mating terminal in the form of a round bar inside the angular tube. According to this configuration, the angular tube functions as a cover for protecting the resilient contact pieces. In addition, since the resilient contact pieces and the angular tube are integrated, the number of components can be reduced. The resilient contact pieces are equal in length in a connecting direction to the mating terminal and arranged at positions different in the connecting direction to the mating terminal.

9 Claims, 8 Drawing Sheets

(52) U.S. Cl.
CPC ..... *H01R 13/115* (2013.01); *H01R 24/20* (2013.01); *H01R 43/16* (2013.01); *H01R 4/184* (2013.01); *H01R 2201/26* (2013.01)

(58) Field of Classification Search
USPC ..... 439/851, 852
See application file for complete search history.

(56) References Cited

U.S. PATENT DOCUMENTS

| | | | | |
|---|---|---|---|---|
| 5,658,175 | A * | 8/1997 | Muzslay | H01R 13/111 29/874 |
| 6,547,608 | B2 * | 4/2003 | Sato | H01R 13/11 439/851 |
| 6,899,571 | B1 * | 5/2005 | Koch | H01R 4/4881 439/843 |
| 8,616,924 | B2 * | 12/2013 | Ishida | H01R 13/113 439/851 |
| 8,632,356 | B2 * | 1/2014 | Bihrer | H01R 13/111 439/442 |
| 2012/0202391 | A1 | 8/2012 | Kobayashi et al. | |
| 2014/0038473 | A1 | 3/2014 | Kojima et al. | |

FOREIGN PATENT DOCUMENTS

| | | |
|---|---|---|
| JP | 10-321278 | 12/1998 |
| JP | 2007-179986 | 2/2007 |
| JP | 2012-164486 | 8/2012 |
| JP | 2012-227090 | 11/2012 |
| JP | 22013-25988 | 2/2013 |

* cited by examiner

MULTI-CONTACT TERMINAL

BACKGROUND

1. Field of the Invention

The present invention relates to a multi-contact terminal.

2. Description of the Related Art

A known multi-contact terminal for large current in an electric vehicle or the like is capable of suppressing the amount of heat generation by being held in contact at a multitude of contact points and reducing contact resistance. Japanese Unexamined Patent Publication No. 2012-164486 is an example of such a known multi-contact terminal. This terminal is formed such that plural resilient contact pieces are brought into contact with a male tab in the form of a flat plate. The resilient contact pieces are provided to face each other and extend forward in a cantilever manner from the front end edges of a ceiling plate and a bottom plate of a base portion having a flat rectangular tube shape. These resilient contact pieces are protected by being covered by a separate cover.

Japanese Unexamined Patent Publication No. 2012-227090 is another known example of the multi-contact terminal. This terminal is formed such that plural resilient contact pieces are brought into contact with the outer peripheral surface of a round pin in the form of a bar having a circular cross-section. The resilient contact pieces are provided to extend forward in a cantilever manner from the front end edge of a cylindrical tube portion.

In the multi-contact terminal of Japanese Unexamined Patent Publication No. 2012-164486 described above, the male tab and the resilient contact pieces are held in line contact. Thus, if the male tab is inserted between the facing resilient contact pieces in a posture inclined from a proper connection posture, the male tab locally is pressed strongly against the resilient contact pieces and, conversely, the male tab and the resilient contact pieces partly experience contact failures. Further, strong local pressing of the male tab against the resilient contact pieces, as just described, easily can peel platings off the resilient contact pieces by abrasion and can impair durability.

On the other hand, in the multi-contact terminal for round pin shown in Japanese Unexamined Patent Publication No. 2012-227090, the plurality of resilient contact pieces are shaped in conformity with the outer peripheral surface of the round pin. Since these resilient contact pieces are produced by forming slits in a cylindrical member and performing drawing, there is a problem of being difficult to improve dimensional accuracy and difficult to produce.

Further, in both multi-contact terminals, if a cover for protecting the resilient contact pieces is provided, the number of components increases and the structure becomes complicated, thereby presenting a problem of making an assembling operation cumbersome.

The present invention was completed based on the above situation and aims to provide a multi-contact terminal configured to bring a plurality of resilient contact pieces into contact with a mating terminal, wherein the multi-contact terminal has a small number of components, a simple configuration, an easy production, having a plating that is difficult to peel off a surface and excellent durability.

SUMMARY

A multi-contact terminal of the present invention is developed to solve the above problem and includes an angular tube having a polygonal tube shape. Resilient contact pieces extend from side walls of the angular tube and can be brought resiliently into contact with an outer peripheral surface of a mating terminal in the form of a round bar that is inserted inside the angular tube.

The angular tube functions as a cover for protecting the resilient contact pieces since the resilient contact pieces are connected to the mating terminal inside the angular tube. In addition, the resilient contact pieces and the angular tubes are integrated, so that the number of components can be reduced.

The multi-contact terminal of the present invention can be produced by bending. Thus, it is not necessary to perform drawing as in conventional multi-contact terminals for round pin, and accordingly, the multi-contact terminal can be produced easily. Further, a dimensional control for bending is easy. Therefore, a contact pressure can be adjusted easily and a plating is difficult to peel off a surface of the multi-contact terminal.

The multi-contact terminal of the present invention may have the following configurations.

The plurality of resilient contact pieces may be equal in length in a connecting direction to the mating terminal and arranged at positions different in the connecting direction to the mating terminal. In this configuration, the resilient contact pieces contact the mating terminal at positions different in a length direction, i.e. the connecting direction. Thus, the multi-contact terminal is prevented from being obliquely connected to the mating terminal. Specifically, since the multi-contact terminal is connected in a proper posture to the mating terminal, the resilient contact pieces are not abraded strongly against local areas of the mating terminal and the plating is less likely to be peeled off.

Further, the angular tube may include expanded portions adjacent to base end parts of the resilient contact pieces and extending along an extending direction of the resilient contact pieces. The expanded portions increase the rigidity of base end parts of the resilient contact pieces. Thus, the base end parts of the resilient contact pieces are prevented from being pressed and deformed by the mating terminal when the mating terminal is inserted.

The resilient contact pieces may extend from front end edges of the side walls of the angular tubes in the connecting direction to the mating terminal and may be folded to extend back by folding portions, and the expanded portions may extend more forward than the folding portions. The forwardly extended expanded portions protect the folding portions even if the mating terminal or a device collides with the multi-contact terminal from the front. Thus, the deformation of the resilient contact pieces can be prevented.

The angular tube may be formed by bending a plate-like member into an angular tube shape and closed not to open by fixing end edges of the plate-like member in a bending direction to each other. Thus, the multi-contact terminal can be produced easily.

According to the invention, the multi-contact terminal has a small number of components, has a simple configuration, is produced easily, is not likely to peel off plating and is excellent in durability.

DETAILED DESCRIPTION

Hereinafter, a first embodiment is described in detail with reference to FIGS. 1 to 3.

A multi-contact terminal of this embodiment is a large-current terminal used in a power supply line or the like of an electric vehicle, a hybrid vehicle or the like. The multi-contact terminal is, as shown in FIG. 1, a female terminal 20 into which a mating male terminal 10 in the form of a round bar is fittable, and is configured such that resilient contact pieces 30 provided in the female terminal 20 are brought into contact with the outer peripheral surface of the male terminal 10. In the following description, a side of each constituent member to be connected to the mating terminal in a connecting direction (arrow D of FIG. 2) is referred to as a front side and an opposite side thereof as a rear side. Further, upper and lower sides of FIG. 2 are referred to as upper and lower sides.

The male terminal 10 is formed of a metal material excellent in electrical conductivity, such as a copper alloy. One end of the male terminal 10 is connected to an unillustrated wire and the other end side is formed as a connecting portion 11 in the form of a round bar. A slightly tapered guiding surface 11A is formed on a tip part of the connecting portion 11 (see FIG. 3).

Figure 1:
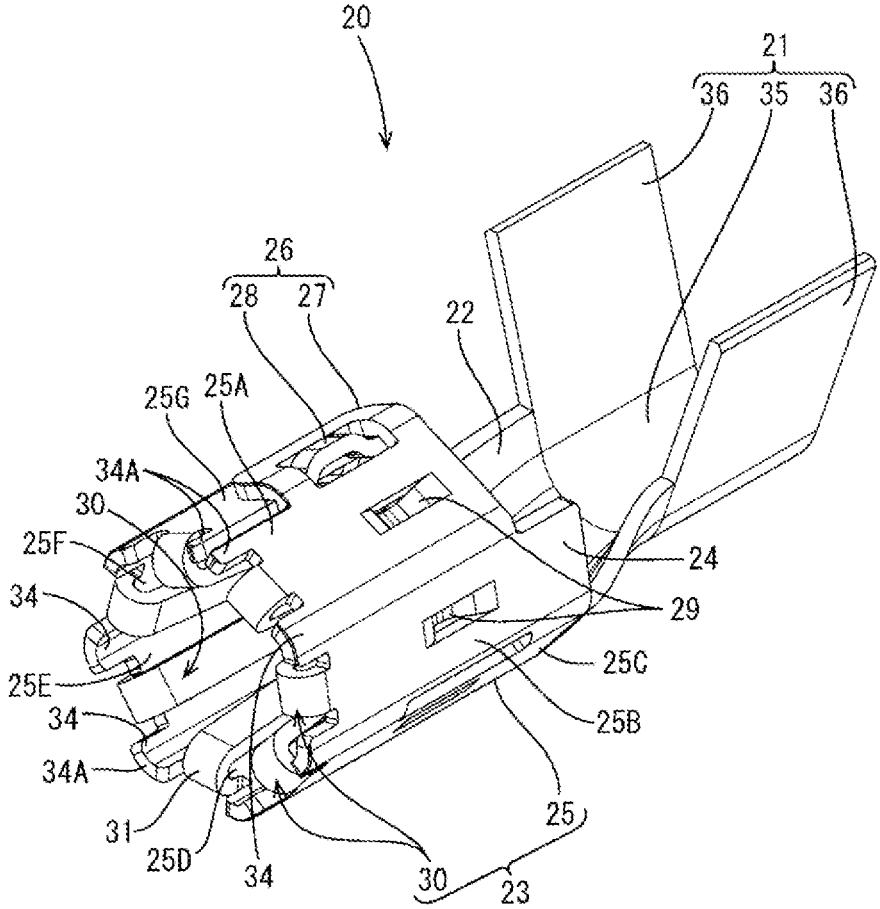
FIG. 1 is a perspective view of a multi-contact terminal of a first embodiment.
Figure 2:
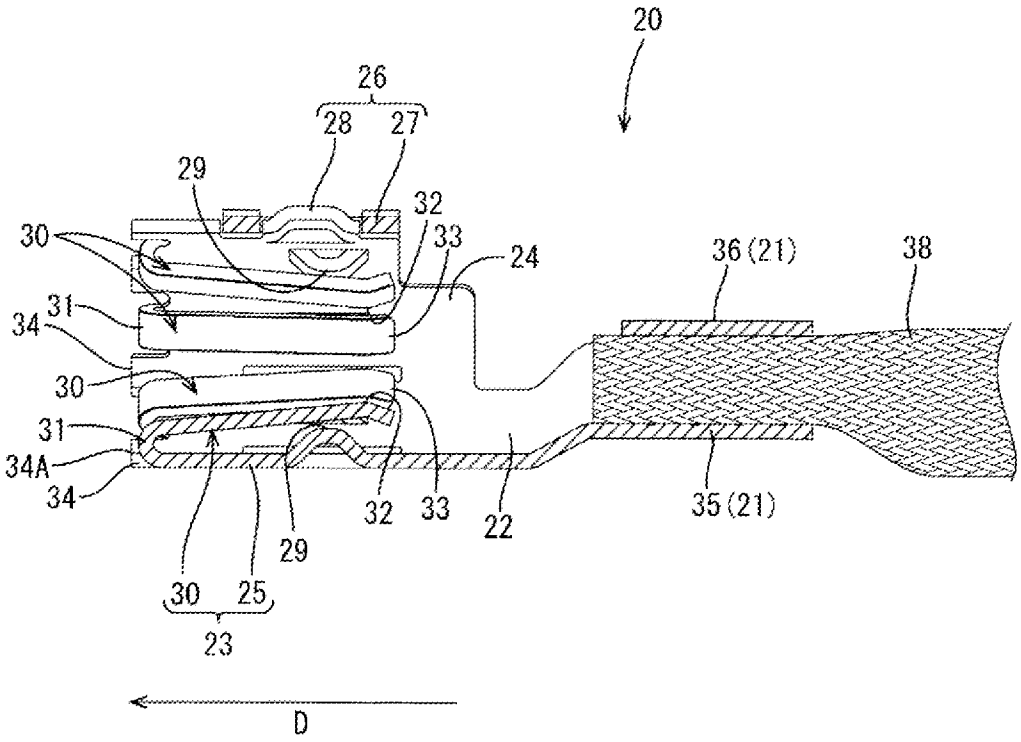
FIG. 2 is a section of the multi-contact terminal of the first embodiment.
Figure 3:
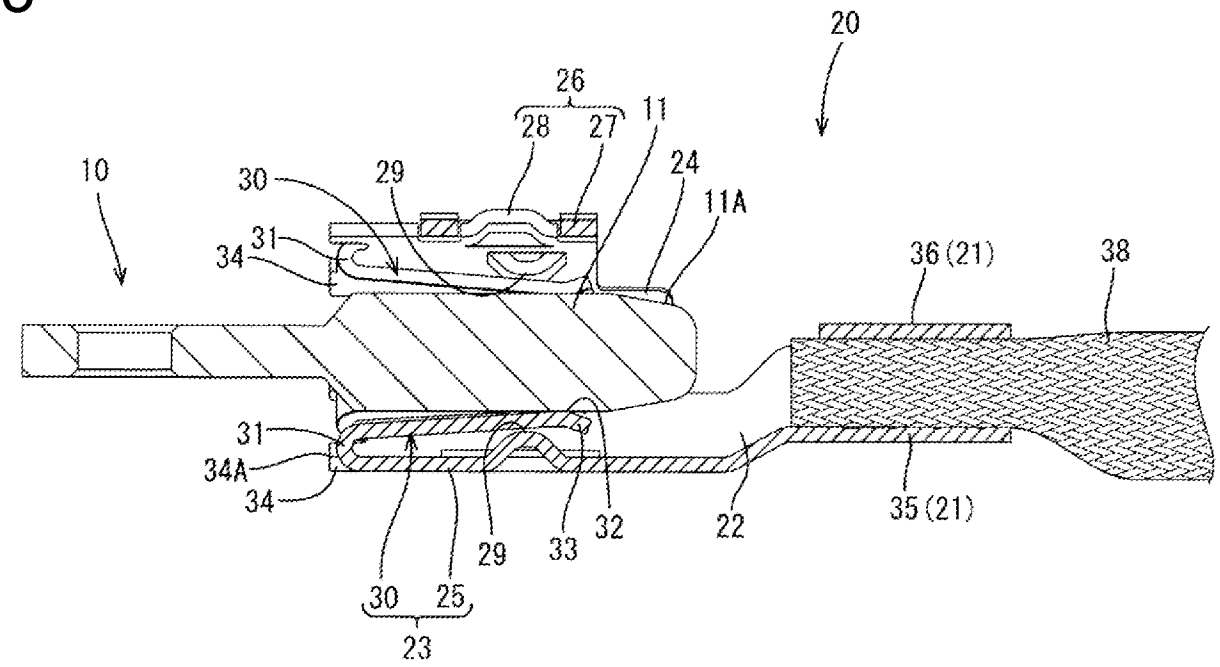
FIG. 3 is a section showing a state where the multi-contact terminal of the first embodiment is connected to a mating terminal.

The female terminal 20 is formed by press-working a metal plate excellent in electrical conductivity, such as a copper alloy, into a predetermined shape, as shown in FIGS. 1 and 2. The female terminal 20 is configured such that a wire connecting portion 21 to be connected to a wire 38 and a main body 23 to be connected to the connecting portion 11 of the male terminal 10 are connected one after the other via a linking portion 22.

The main body 23 includes an angular tube 25 having a substantially heptagonal tube shape. Seven resilient contact pieces 30 extend integrally forward from the front end edge of the angular tube 25 and are folded inwardly.

The angular tube 25 is formed into the substantially heptagonal tube shape by bending a flat metal plate into a shape having a substantially heptagonal cross-section, and closed not to open by butting end edges in a bending direction against each other and locking the end edges by a locking portion 26. The locking portion 26 is composed of a square-shaped locking piece 27 extending from one end side in the bending direction of the angular tube 25 and a locking projection 28 formed by cutting and bending to project on the outer surface of the other end side. The angular tube 25 is closed not to open by externally fitting the locking piece 27 to the outwardly projecting locking projection 28 from an outer side while slightly bending the locking piece 27 after the metal plate is bent into a heptagonal tube shape.

An inwardly projecting regulating protrusion 29 is formed by cutting and bending on a side of each side wall of the angular tube 25 slightly behind a center (see FIG. 2). These regulating protrusions 29 regulate excessive deformation of the resilient contact pieces 30. Seven regulating protrusions 29 are arranged at the same position in a front-back direction.

The respective side walls of the angular tube 25 having the substantially heptagonal tube shape are denoted successively by 25A, 25B, 25C, 25D, 25E, 25F and 25G from the side wall provided with the locking piece 26, and the linking portion 22 extends backward from the rear end edges of the side walls 25C, 25D and 25E. Further, a reinforcing portion 24 extends back from the rear end edges of the side walls 25B, 25F. The linking portion 22 and the reinforcing portion 24 are formed integrally.

On the other hand, the seven resilient contact pieces 30 extend forward from the front end edges of the respective side walls 25A to 25G of the angular tube 25 and are folded inward of the angular tube 25 at the same position (referred to as folding portions 31) in the front-back direction. As shown in FIG. 2, the resilient contact piece 30 extends obliquely inward toward a tip side (rear side) after being folded inward by the folding portion 31, and a tip part is bent to extend obliquely out. A most inwardly protruding part (bent part) of the resilient contact piece 30 defines a contact portion 32 to be held in point contact with the connecting portion 11 of the male terminal 10. The contact portion 32 is located behind the regulating protrusion 29 in the angular tube 25. Further, a tip portion 33 of the resilient contact piece 30 is dimensioned to be located before the rear end of the angular tube 25.

A width of each resilient contact piece 30 is set to be smaller than that of each side wall 25A to 25G.

The seven resilient contact pieces 30 are identically shaped in all dimensions such as a length, a width and a bent shape.

Expanded portions 34 extend forward between extending parts (base end parts) of the adjacent resilient contact pieces 30 on the front end edge of the angular tube 25. The angular tube portion 25 is folded along the front-back direction at these expanded portions 34 into the substantially heptagonal shape. Note that end expanded portions 34A having a half width of the expanded portion 34 are provided on the opposite end edges of the angular tube 25 in the bending direction before press molding, and the expanded portion 34 having the same width as the other expanded portions 34 can be formed by butting the end expanded portions 34A against each other by press molding.

The folding portions 31 of the resilient contact pieces 30 described above are set to be located behind the front ends of these expanded portions 34 (see FIG. 2).

The wire connecting portion 21 extends back from the rear end edge of the linking portion 22 and is composed of a placing portion 35 and two barrel portions 36 extending obliquely up from opposite sides of the placing portion 35.

The female terminal 20 of this embodiment is configured as described above. Next, a method for producing the female terminal 20 is described.

First, the resilient contact pieces 30 are formed into predetermined shapes by bending (press-working) parts corresponding to the resilient contact pieces 30 of the metal plate punched out into a predetermined shape. Then, the wire connecting portion 21 and the linking portion 22 are bent and the metal plate is folded along the front-back direction at the positions corresponding to the expanded portions 34, thereby forming the angular tube 25. The angular tube 25 is closed not to open by locking the locking piece 27 to the locking projection 28 formed on the one end side in the bending direction in such a manner as to cover the locking piece 27 over the locking projection 28 from an outer side while bending the locking piece 27. In this way, the female terminal 20 having a predetermined shape shown in FIG. 1 is obtained.

Next, a connecting operation of the male terminal 10 and the female terminal 20, functions and effects are described.

First, the connecting portion 11 of the male terminal 10 is inserted into the female terminal 20 that has been connected to the wire 38 by crimping the wire connecting portion 21 to the wire 38. More particularly, the connecting portion 11 thrusts itself among the seven contact portions 32 while resiliently deforming all the resilient contact pieces 30 outward. The expanded portions 34 extending from the angular tube portion 25 are provided between the adjacent resilient contact pieces 30, and the base end parts of the respective resilient contact pieces 30 are made more rigid by these expanded portions 34. Thus, the base end parts of the resilient contact pieces 30 are not lifted and pushed to a back side (rear side) of the angular tube 25 as the connecting portion 11 is inserted.

Further, since an odd number (seven) of the resilient contact pieces 30 are provided, no resilient contact piece 30 is arranged on an axis of symmetry of another resilient contact piece 30 in a radial direction of the angular tube 25. Thus, each resilient contact piece 30 presses the connecting portion 11 toward a corner part (expanded portion 34) facing the respective resilient contact piece 30. When such an action works at all the seven resilient contact pieces 30, the connecting portion 11 is pressed at a contact pressure equal in all seven directions, with the result that the male terminal 10 is inserted to the back side of the main body 23 without an inserting direction being inclined (without being pried).

When being further inserted to reach a proper position in the angular tube 25, the connecting portion 11 is held resiliently and tightly by the respective contact portions 32 of the resilient contact pieces 30. In this way, the male and female terminals 10, 20 are connected electrically (see FIG. 3). At this time, since the seven contact portions 32 are provided at the same position in the front-back direction and pressing the connecting portion 11 at the contact pressure equal in all the seven directions, the connecting portion 11 is held stably in a center of the main body 23.

As just described, according to the female terminal 20 of this embodiment, the resilient contact pieces 30 are unitary with angular tube 25. Thus, it is not necessary to provide a separate cover for protecting the resilient contact pieces 30 and the number of components can be reduced. Further, since the tips of the expanded portions 34 extend farther forward than the folding portions 31 of the resilient contact pieces 30, even if a device or the mating terminal collides in a direction different from the connecting direction from the front of the female terminal 20, the folding portions 31 of the resilient contact pieces 30 can be protected and prevented from deformation.

Further, since the female terminal 20 is formed easily by bending one metal plate and simply configured to lock the end parts in the bending direction by the locking portion 26. Further, since a dimensional control for bending is easy, the contact pressure can be adjusted easily and the multi-contact terminal can have a plating difficult to peel off on the surface.

Next, a second embodiment is described in detail with reference to FIGS. 4 to 8. Note that components similar to those of the first embodiment are denoted by the same reference signs and repeated description is omitted below.

Figure 4:
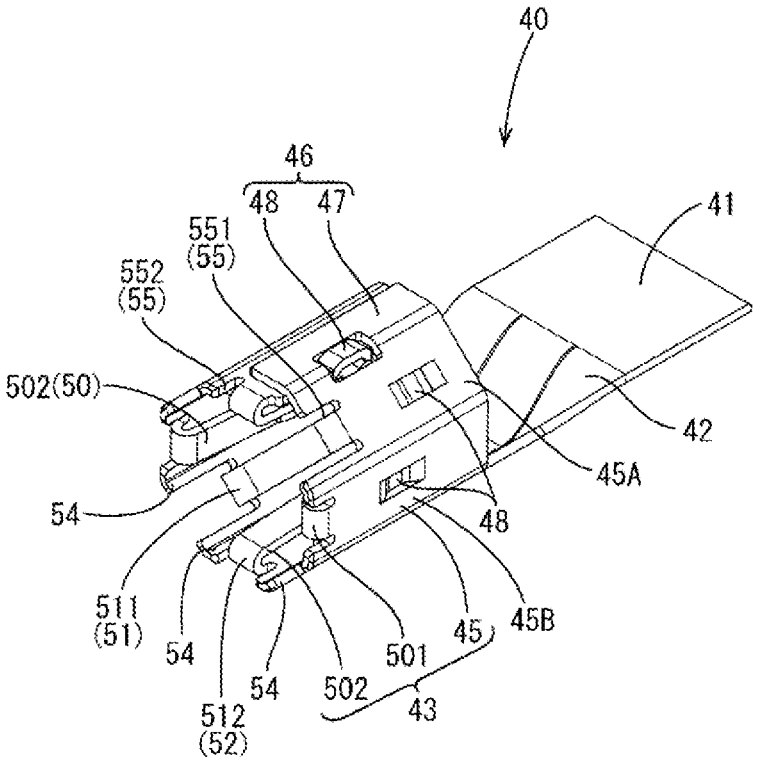
FIG. 4 is a perspective view of a multi-contact terminal of a second embodiment.
Figure 5:
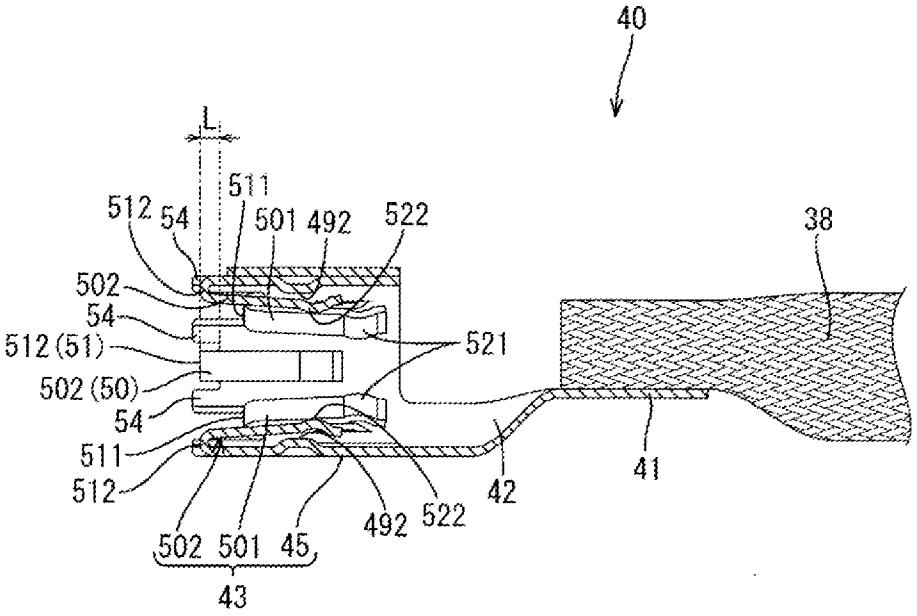
FIG. 5 is a section of the multi-contact terminal of the second embodiment.
Figure 6:
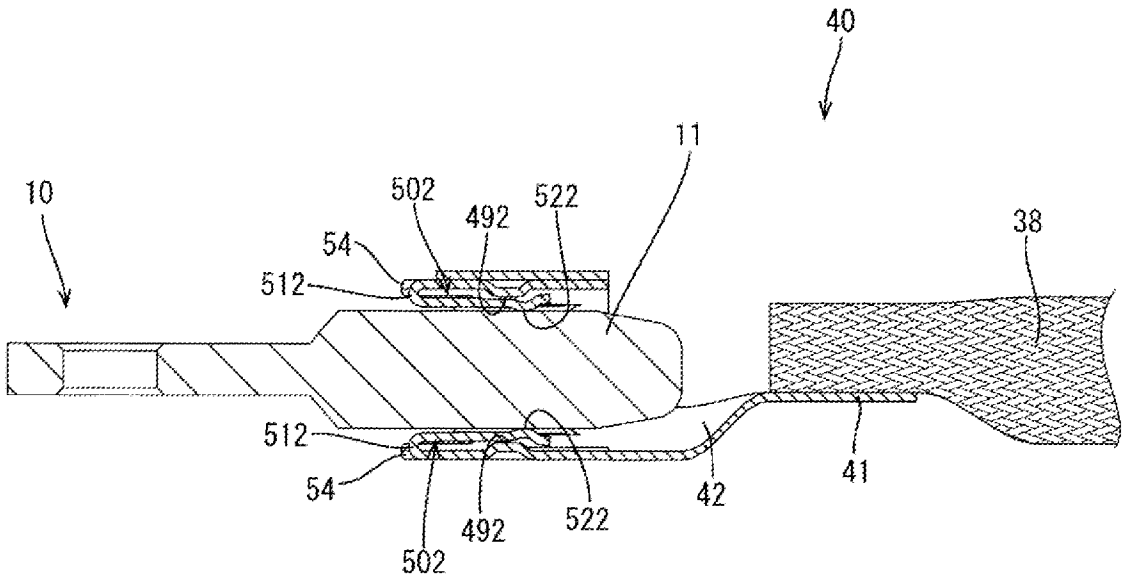
FIG. 6 is a section showing a state where the multi-contact terminal of the second embodiment is connected to a mating terminal.

As shown in FIGS. 4 and 5, a female terminal 40 of this embodiment is configured such that a wire connecting portion 41 to be connected to a wire 38 and a main body 43 to be connected to a connecting portion 11 of a male terminal 10 are connected one after the other via a linking portion 42.

The main body 43 includes an angular tube 45 having a substantially octagonal tube shape. Eight resilient contact pieces 50 extend forward from the front end edge of the angular tube 45 and are folded inward.

Figure 7:
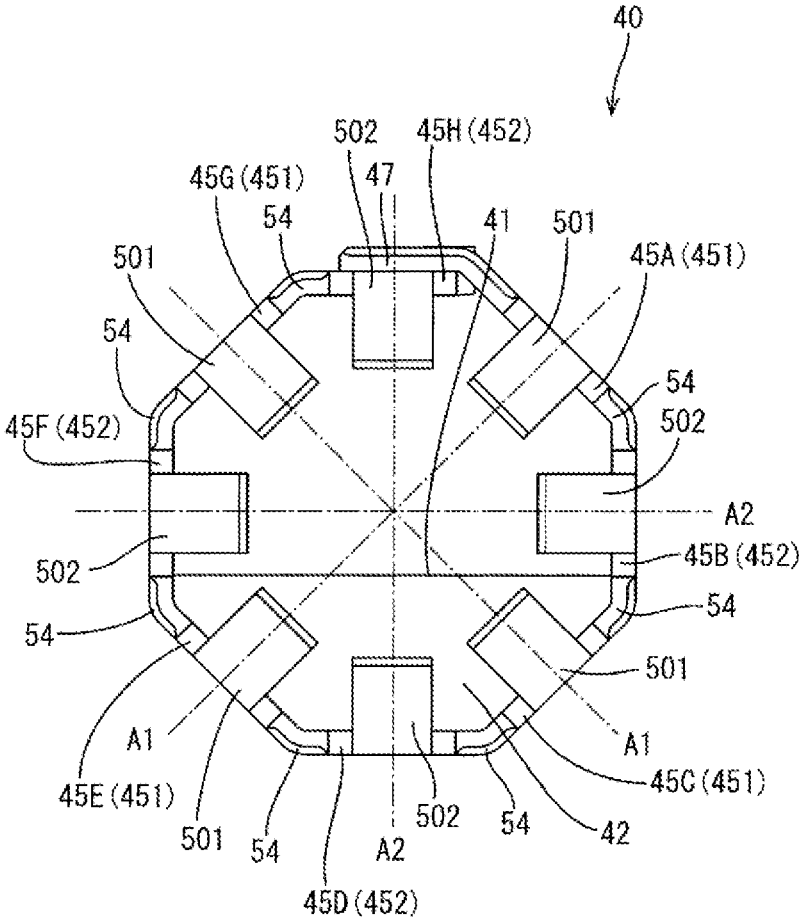
FIG. 7 is a front view of the multi-contact terminal.
Figure 8:
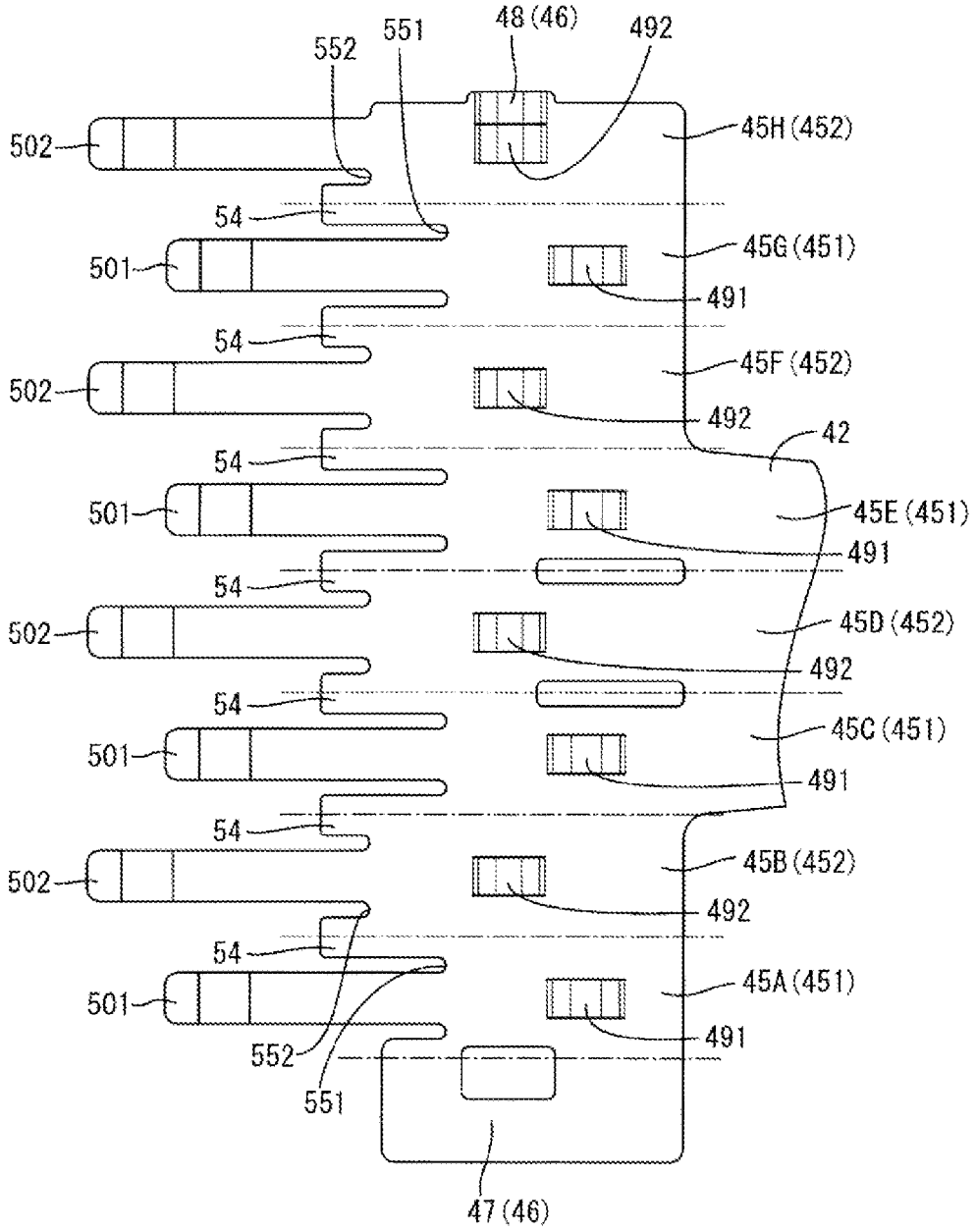
FIG. 8 is a partial development of the multi-contact terminal.

The angular tube 45 is formed into the substantially octagonal tube shape by bending a flat metal plate punched out into a development shape, as shown in FIG. 8, into a shape having a substantially octagonal cross-section by a press molding machine (see FIG. 7). Opposite end edges of the angular tube 45 in a bending direction are closed not to open by being locked to each other by a locking portion 46 composed of a locking piece 47 extending from one end side and a locking projection 48 projecting outwardly on the other end side.

The eight side walls of the angular tube 45 are denoted successively by 45A, 45B, 45C, 45D, 45E, 45F, 45G and 45H from the one provided with the locking piece 47.

In this embodiment, as shown in FIG. 8, the angular tube 45 is composed of two types of side walls having different lengths in the front-back direction. Specifically, the side walls 45A, 45C, 45E and 45G are first side walls 451, and the side walls 45B, 45D, 45F and 45H are second side walls 452 having a longer length in the front-back direction than the first side walls 451. Widths (vertical dimensions in FIG. 8) of the first and second side walls 451, 452 are equal. The angular tube 45 is formed into a substantially comb shape in a developed state by alternately arranging these first and second side walls 451, 452 with the rear end positions thereof aligned on the same straight line.

An inwardly projecting regulating protrusion 49 is formed by cutting and bending near a center of each side wall 45A to 45H of the angular tube 45 (see FIG. 5). Specifically, first regulating protrusions 491 formed on the first side walls 451 (side walls 45A, 45C, 45E and 45G) are provided behind second regulating protrusions 492 formed on the second side walls 452 (side walls 45B, 45D, 45F and 45H) and these regulating protrusions are arranged while being displaced from each other in the front-back direction (see FIG. 8).

On the other hand, the eight resilient contact pieces 50 are formed to extend forward from the front end edges of the respective side walls 45A to 45A of the angular tube 45 in the developed state shown in FIG. 8. The resilient contact pieces 50 have widths that are about half the widths of the first and second side walls 451, 452, and extend from widthwise central parts of the respective side walls 45A to 45H.

The eight resilient contact pieces 50 are equal in length in the front-back direction and width. First resilient contact pieces 501 extending from the first side walls 451 (side walls 45A, 45C, 45E and 45G) are arranged while being displaced back from second resilient contact pieces 502 extending from the second side walls 452 (side walls 45B, 45D, 45F and 45H).

A total of seven expanded portions 54 extend forward from positions between extending parts (base end parts) of the resilient contact pieces 50 (first resilient contact pieces 501 and second resilient contact pieces 502) adjacent in the developed state shown in FIG. 8 on the front end edge of the angular tube 45. The front end edges of these seven expanded portions 54 all are arranged on the same line.

More specifically, lengths of slits 55 provided between one expanded portion 54 and its adjacent resilient contact pieces 50 differ at opposite sides of the expanded portion 54, and the length of the first slit 551 located on the side of the first side wall 451 is longer than that of the second slit 552 located on the side of the second side wall 452. By making the lengths of the slits 55 different in this way, the first and second resilient contact pieces 501, 502 are arranged at positions different in the front-back direction.

Note that no expanded portion 54 is provided on the front end edges of the opposite side edges in the bending direction of the angular tube 45 in the developed state. Instead, the locking piece 47 is formed to extend forward from the angular tube 45 (side wall 45A) on one side and this locking piece 47 has a function similar to that of the expanded portions 54 in an assembled state. Note that the front end edge of the locking piece 47 is arranged behind the front end edges of the expanded portions 54. Further, a width of the locking piece 47 is larger than those of the expanded portions 54.

The angular tube 45 is bent along the front-back direction at these expanded portions 54 (dotted lines of FIG. 8) into the substantially octagonal tube shape (see FIG. 7).

As shown in FIG. 5, the resilient contact pieces 50 are folded inwardly of the angular tube 45 from folding portions 51 at positions spaced forward a predetermined distance L from extending base end parts of the respective side walls 45A to 45H. Specifically, first folding portions 511 of the first resilient contact pieces 501 and folding portions 512 of the second resilient contact pieces 502 are arranged while being displaced in the front-back direction. These folding portions 51 are set to be located behind the front ends of the expanded portions 54.

As shown in FIG. 5, the resilient contact piece 50 is shaped to extend obliquely inward toward a tip side (rear side) after being folded inward by the folding portion 51, and a tip part is bent to extend obliquely outward. A most inwardly protruding part defines a contact portion 52 to be held in point contact with the connecting portion 11 of the male terminal 10.

The eight resilient contact pieces 50 all are bent into the same shape. Specifically, first contact portions 521 of the first resilient contact pieces 501 are arranged behind second contact portions 522 of the second resilient contact pieces 502. Further, these respective contact portions 52 are set to be located behind the regulating protrusions 49 of the respective resilient contact pieces 50. Furthermore, a tip part (rear end part) of each resilient contact piece 50 is located before the rear end of the angular tube 45.

Further, the linking portion 42 extends from the rear end edges of the side walls 45C, 45D and 45E and the wire connecting portion 41 in the form of a flat plate extends back from the rear end of the linking portion 42 (see FIG. 4). The linking portion 42 and the wire connecting portion 41 have the same width. The wire 38 is welded to the wire connecting portion 41.

If the wire 38 is welded to the wire connecting portion 41 in this way, a plate thickness of the multi-contact terminal can be reduced as compared to the configuration in which the wire 38 is crimped, as in the first embodiment. Further, by reducing the plate thickness, it is possible to increase a curvature R (a value defined by 1/r when r denotes a radius of curvature) of the folding portions 51 of the resilient contact pieces 50 and miniaturize the multi-contact terminal.

The female terminal 40 of this embodiment is configured as described above. Next, a connecting operation of the male terminal 10 and the female terminal 40, functions and effects are described.

When the connecting portion 11 of the male terminal 10 is inserted into the female terminal 40 connected to the wire 38, the connecting portion 11 first thrusts itself among the second contact portions 522 while resiliently deforming all the resilient contact pieces 50 outward. At this time, the connecting portion 11 mainly is held resiliently and tightly by four second contact portions 522 arranged on two axes of symmetry A2 (see FIG. 7) orthogonal to each other.

When being further inserted backward, the connecting portion 11 thrusts itself among the first contact portions 521. When the connecting portion 11 is inserted to a proper position in the angular tube 45, a tip side of the connecting portion 11 is held resiliently and tightly by four first contact portions 521 arranged on two axes of symmetry A1 (see FIG. 7) orthogonal to each other. In this way, the male and female terminals 10, 40 are connected electrically. Note that the axes of symmetry A1, A2 are arranged at positions displaced 45° in a circumferential direction as shown in FIG. 7.

Specifically, the connecting portion 11 has the tip side (rear side) tightly held by the four first contact portions 521 and has the base end side (front side) tightly held by the four second contact portions 522 located at the positions displaced 45° from the first contact portions.

As just described, according to the female terminal 40 of this embodiment, the following functions and effects can be obtained in addition to functions and effects similar to those of the first embodiment. Specifically, the connecting portion 11 of the male terminal 10 is held tightly by the first contact portions 521 on the tip side and is held tightly by the second contact portions 522 on the base end side. Thus, the connecting portion 11 of the male terminal 10 can be held at positions different in the front-back direction and in the circumferential direction in the main body portion 43. In addition, since all the resilient contact pieces 50 are identically dimensioned and shaped, contact pressures with the male terminal 10 can be made equal at all the contact portions 52. Specifically, since the relative inclination (prying) of the both terminals is unlikely to occur, it is possible to provide a multi-contact terminal having a plating more difficult to peel off on the surface thereof and excellent in durability.

Further, insertion resistance is maximized when the connecting portion 11 of the male terminal 10 thrusts itself among the contact portions 52 when inserting the connecting portion 11 into the female terminal 40. Since the eight contact portions 52 are arranged in a distributed manner in the front-back direction according to the female terminal 40 of this embodiment, insertion resistance is reduced and operability during the connecting operation is improved.

Further, the resilient contact pieces 50 are facing each other in the radial directions of the angular tube 45 when the angular tube 45 has a polygonal shape with an even number of sides as in this embodiment. Thus, a distance between the contact portions 52 is controlled easily and production is easy as compared to the case where the angular tube 45 has a polygonal shape with an odd number of sides.

The invention is not limited to the above described and illustrated embodiments. For example, the following embodiments are also included in the scope of the invention.

Although the resilient contact pieces 30, 50 extend from the front end edges of the angular tubes 25, 45 in the above embodiments, they may extend from the rear end edges and be folded to extend forward.

Although the angular tubes 25, 45 of the female terminals 20, 40 are closed not to open by locking the end edges in their bending directions by the locking portions 26, 46 in the above embodiments, it is not always necessary to adopt this configuration. For example, the angular tube may be closed not to open by welding or the like.

Although one expanded portion 34, 54 provided adjacent to the base end part of one resilient contact piece 30, 50 serves as the expanded portion 34, 54 of the adjacent resilient contact pieces 30, 50 and is provided between each pair of the resilient contact pieces 30, 50 adjacent to each other in the above embodiments, one expanded portion may be provided for each resilient contact piece 30, 50, i.e. two expanded portions may be provided between each pair of resilient contact pieces 30, 50 adjacent to each other.

Further, the expanded portions 34, 54 need not always be provided and can be omitted.

Although the resilient contact pieces 30, 50 extend from all the plurality of side walls of the angular tubes 25, 45 in the above embodiments, they may extend only from selected side walls.

Although the angular tubes 25, 45 have substantially the heptagonal tube shape and the substantially octagonal tube shape in the above embodiments, they have only to have a polygonal tube shape having three or more sides.

Although the respective contact portions 32 are provided at the same position in the front-back direction in the first embodiment and the respective contact portions 52 are provided at two positions in the front-back direction in the second embodiment, they may be provided at three or more positions in the front-back direction.

LIST OF REFERENCE SIGNS

10 . . . male terminal (mating terminal)
20, 40 . . . female terminal (multi-contact terminal)
25, 45 . . . angular tube portion
25A to 25G, 45A to 45H . . . side wall
26, 46 . . . locking portion
27, 47 . . . locking piece
28, 48 . . . locking projection
30, 50 . . . resilient contact piece
31, 51 . . . folding portion
34, 54 . . . expanded portion

The invention claimed is:

1. A multi-contact terminal, comprising:

a polygonal tube with opposite front and rear ends, the polygonal tube comprising first and second pluralities of side walls consecutively folded relative to one another along fold lines that extend in a front-back direction so that each of the first side walls is connected to two of the second side walls and each of the second side walls is connected to two of the first side walls, each of the side walls having opposite front and rear ends;

first resilient contact pieces extending respectively from positions in proximity to the front ends of the first side walls of the polygonal tube, each of the first resilient contact pieces being folded rearward at first front folds to extend into the polygonal tube;

second resilient contact pieces extending respectively from positions in proximity to the front ends of the second side walls of the polygonal tube, each of the second resilient contact pieces being folded rearward at second front folds to extend into the polygonal tube;

all of the resilient contact pieces being substantially identically dimensioned and shaped for exerting substantially equal pressures on a mating terminal inserted into the polygonal tube; and the first front folds being aligned with a first position in the front-back direction and the second front folds being aligned with a second position in the front-back direction, the first position being closer to the front end of the rectangular tube than the second position for reducing an initial insertion resistance on the mating terminal inserted into the front end of the polygonal tube.

2. The multi-contact terminal of claim 1, further comprising expanded portions projecting forward from the front ends of the side walls at positions aligned with the fold lines between the consecutively folded side walls, the expanded portions being spaced from the resilient contact pieces in directions transverse to the front-back direction.

3. The multi-contact terminal of claim 2, wherein the expanded portions extend more forward than the first and second front folds.

4. The multi-contact terminal of claim 1, wherein the polygonal tube is formed by bending a plate into a polygonal tubular shape and fixing end edges of the plate to each other.

5. The multi-contact terminal of claim 1, wherein the front folds of the respective resilient contact pieces extend in directions transverse to the front-back direction.

6. The multi-contact terminal of claim 1, wherein the even number of side walls comprises at least four side walls.

7. The multi-contact terminal of claim 6, wherein the even number of side walls comprises eight side walls.

8. The multi-contact terminal of claim 1, further comprising a connecting portion rearward of in the polygonal tube and having a placing portion extending rearward from the polygonal tube and two barrel portions extending from opposite sides of the placing portion.

9. The multi-contact terminal of claim 1, further comprising an inwardly projecting regulating protrusion formed on each of the side walls at a position facing the resilient contact piece extending from the respective side wall.

* * * * *